United States Patent [19]

Schmitz

[11] 4,293,087

[45] Oct. 6, 1981

[54] APPARATUS FOR INTRODUCING THE HEAD END OF A WEB INTO A TREATING STATION

[75] Inventor: Rolf Schmitz, Monchengladbach, Fed. Rep. of Germany

[73] Assignee: Jagenberg Werke, Dusseldorf, Fed. Rep. of Germany

[21] Appl. No.: 135,015

[22] Filed: Mar. 28, 1980

[30] Foreign Application Priority Data

Apr. 19, 1979 [DE] Fed. Rep. of Germany ..... 2915747

[51] Int. Cl.[3] ..... B65H 17/34

[52] U.S. Cl. ..... 226/172

[58] Field of Search ..... 226/172, 171, 173; 242/74

[56] References Cited

U.S. PATENT DOCUMENTS

| | | | |
|---|---|---|---|
| 1,950,098 | 3/1934 | Casperson | 226/172 X |
| 2,760,626 | 8/1956 | Boughton | 226/171 |
| 3,690,534 | 9/1972 | Biren | 226/173 |
| 3,881,229 | 5/1975 | Reid | 226/173 |

*Primary Examiner*—Edward J. McCarthy

*Attorney, Agent, or Firm*—Sprung, Felfe, Horn, Lynch & Kramer

[57] ABSTRACT

An apparatus for the treatment of a web of material having rolls defining a conveying path of the web includes a mechanism for leading the head end of a web along the conveying path. The mechanism comprises two endless chains on both sides of the conveying path, each having a run thereof extending along the conveying path and a crossbeam connected across the two endless chains for securing the head end of the web during the leading thereof along the conveying path.

7 Claims, 5 Drawing Figures

APPARATUS FOR INTRODUCING THE HEAD END OF A WEB INTO A TREATING STATION

BACKGROUND OF THE INVENTION

The invention relates to an apparatus for leading the head end of a web over the rolls disposed in and/or between treating stations, and in particular feed, tension and guide rolls, with the air of guiding means disposed along the conveying path of the web.

In the course of their continuous passage through treating stations, paper, plastic and fabric webs are usually transported, guided and returned by a plurality of rolls in the station and also between successive stations. Bringing in the head end of a new web or pulling through a torn web then poses difficulties. This has heretofore been done by hand, the head end of the web being pulled over the rolls in the prescribed manner. However, performing this operation manually is complicated and time-consuming.

SUMMARY OF THE INVENTION

The object of the invention is to provide an apparatus whereby the leading of a new or torn web over the rolls in and between treating stations is facilitated and accelerated.

This object is accomplished, in an apparatus of the type outlined above, in that an endless chain is provided as guiding means on either side of the conveying path of the web, these chains being interconnected at least at one point through a crossbeam on which means for fastening the head end of the web is disposed. In place of chains, equivalent means such as ropes, belts or the like may be used. When a web breaks or a new web is to be introduced, the crossbeam connecting the chains is moved to the point where the end of the web is located. That end is then attached to the crossbeam and pulled by means of the chains over the rolls in and between the treating stations. This operation is performed automatically so that only the fastening of the lead end of the web to the crossbeam need to be done by hand. The introduction of the head end of the web thus is facilitated and considerably accelerated.

In accordance with an advantageous embodiment of the apparatus in accordance with the invention, a portion of the crossbeam is formed by two rods with parallel axes, which in one extreme position are in contact with each other along a generatrix, and between which the head end of the web can be clamped after it has been threaded through a clearance between the rods. In place of rods, tubes, rollers or the like may be used. At least one of the two rods is preferably mounted so as to be displaceable perpendicularly to its axis in order that the two rods may be spaced apart. After the head end of the web has been threaded through the clearance so formed, the two rods are again brought into contact with each other so as to clamp said end between them. The head end of the web is then preferably led around and between the rods in such a way that it holds itself. This is done in known manner by passing the head end of the web around the portion of the circumference of one of the rods which faces away from the other rod, and then between the two rods and around the other rod in the opposite direction.

Included in the scope of the invention is the threading of the head end of the web into a slot in a rod, which then is turned until the end of the web has wrapped itself firmly around the rod with, retrograde rotation of the rod, and hence unwinding of the web end wrapped around it, being prevented by a check pawl.

In order that the head end of the web may be effectively clamped between the rods, the latter must be kept in contact with each other, preferably by spring tension. In accordance with a preferred embodiment of the invention, one of the rods may then also be adapted to be displaced against the force of one or more springs which maintain the rods in contact with each other.

In another preferred embodiment of the apparatus in accordance with the invention, pivoted levers may be provided to effect such displacement, said levers being adapted to latch in one extreme position in which the rods are spaced from each other while in the other extreme position in which the rods abut on each other the levers maintain them in contact with each other through spring tension. There is then preferably mounted on each of the facing sides of the chains a plate, these plates being rigidly interconnected by a rod and provided, perpendicularly to the axes of the rods, with a slot in which the second rod is guided to be displaced nonrotatably between a first position in which it is in contact with the other rod and a second position in which it is spaced therefrom, such displacement being effected by means of a pivoted lever mounted on each plate and provided with a notch in which the trunnion or trunnions, guided in the slot, of the displaceable rod is or are lodged, a spring being attached to one end of said pivoted lever, its other end being maintained in the second position, by latching means such as an engageable and disengageable pin, against the force of the spring under tension.

The two pivoted levers are preferably linked by a connecting rod which permits them to be actuated together.

BRIEF DESCRIPTION OF THE DRAWINGS

An embodiment of the apparatus in accordance with the invention is illustrated in the accompanying drawing, wherein.

DETAILED DESCRIPTION OF THE INVENTION

Figure 1:
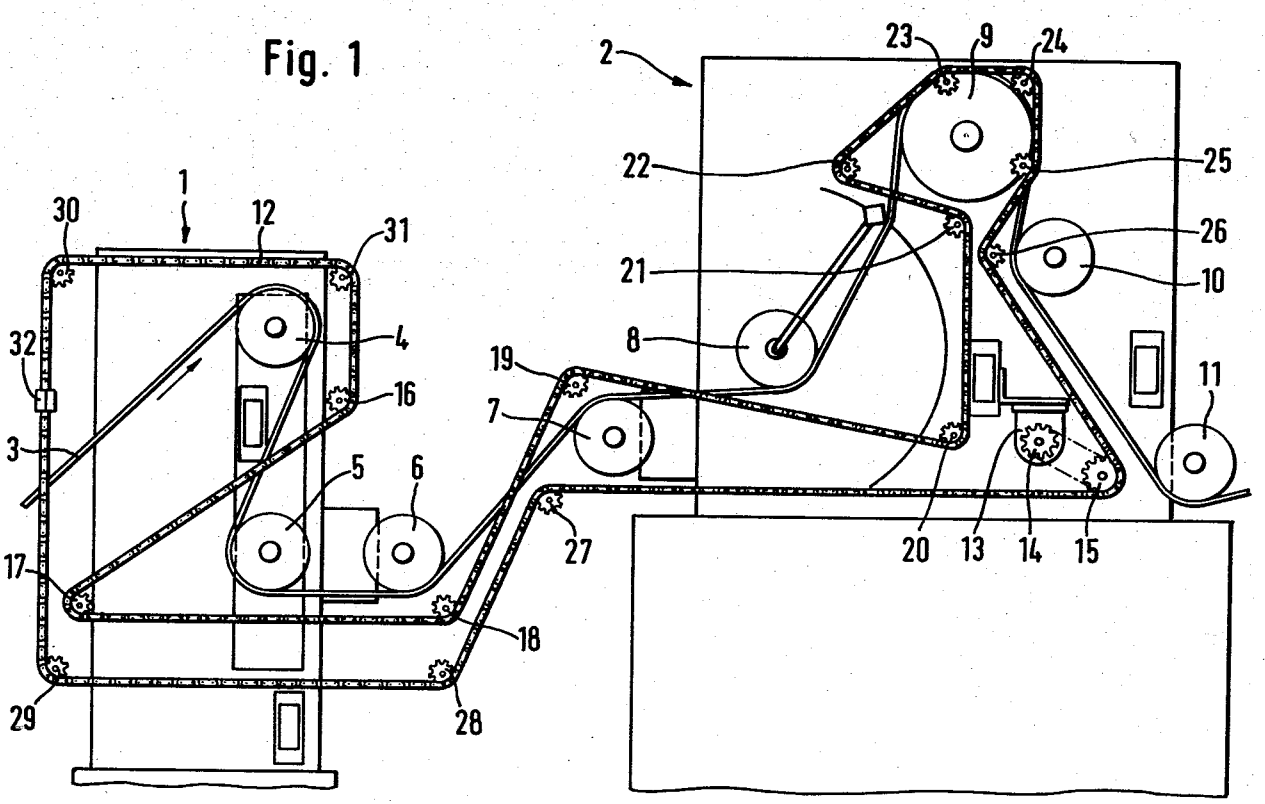
FIG. 1 is a diagrammatic side elevation of two successive treating stations, in and between which the web passes over a plurality of rolls.

Shown in FIG. 1 is a treating station 1 and, following it, a further station 2. In and between these stations, the web 3 passes over a plurality of rolls 4 to 11.

An endless chain 12 is disposed on either side of the conveying path of the web 3 to facilitate the introduction of the head end of a new web or of a web torn between the stations 1 and 2. The chains 12 are set into motion by a drive motor 13 through drive wheels 14 and 15 and along the conveying path of the web 3 are guided by rolls or wheels 16 to 31. The crossbeam, generally designated 32, is disposed at any desired point. It is moved by means of the chains 12 to the particular point where the head end of the new or torn web is located. The latter is fastened to the crossbeam 32 and the web 3 is pulled by the moving chains 12 over the rolls 4 to 11 in and between the treating stations 1 and 2.

Figure 2:
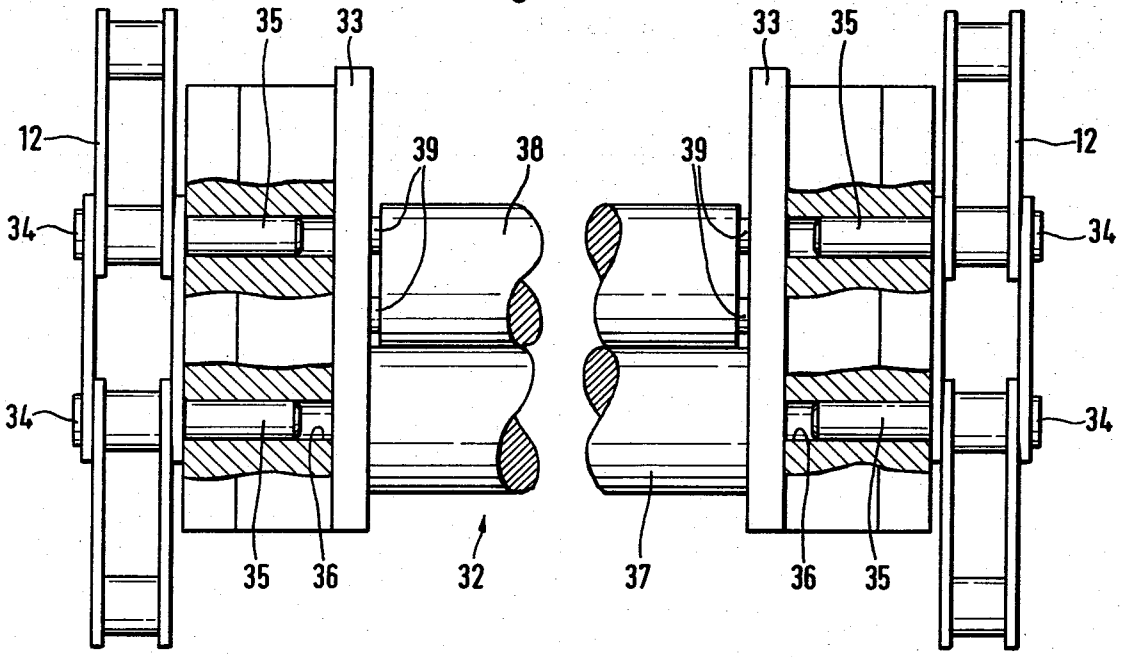
FIG. 2 is a front elevation, partly in section, of an embodiment of the apparatus in accordance with the invention for introduction of the head end of the web.
Figure 5:
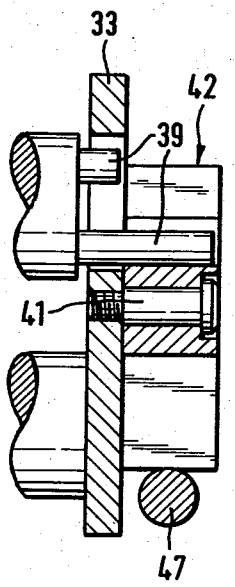
FIG. 5 is a detail view of the apparatus, taken along the line V—V of FIG. 3.
Figure 4:
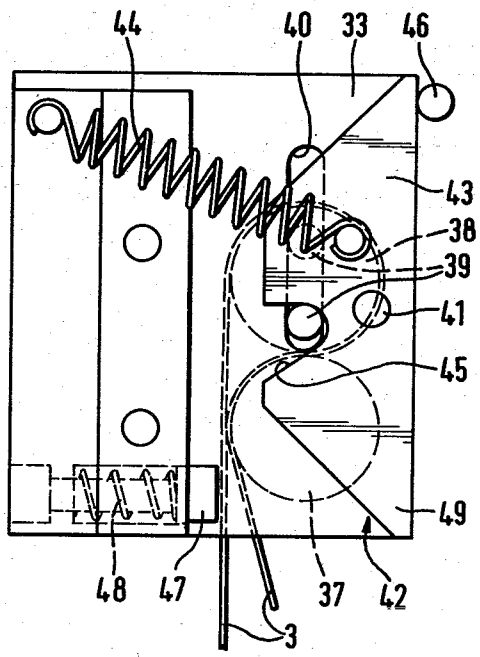
FIG. 4 is the same side elevation as in FIG. 3 but with the apparatus in the position in which the introduced head end of the web has been clamped.
Figure 3:
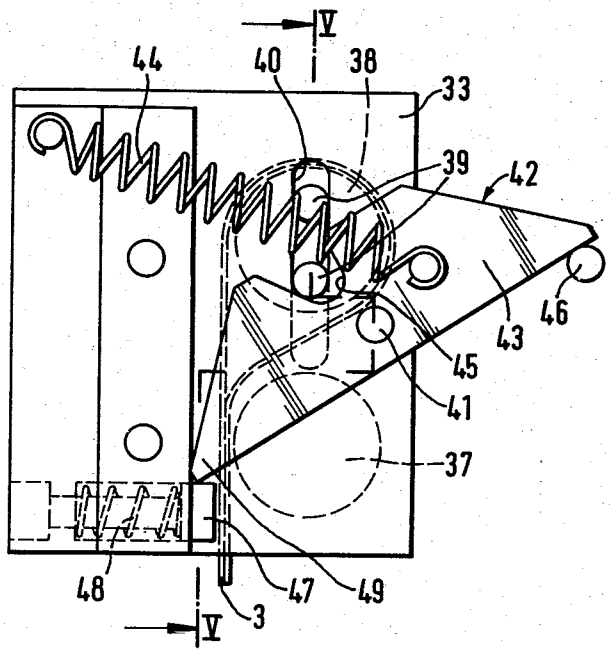
FIG. 3 is a side elevation of the apparatus in the position in which the head end of the web can be introduced into it.

An embodiment of the crossbeam in accordance with the invention for clamping the head end of a web is shown in FIGS. 2 to 4. A plate 33 is mounted on each of the facing sides of the chains 12, which may be done by slipping the plate 33, provided with appropriate holes 36, onto extensions 35 of two adjacent chain-link pins 34, for example.

Rigidly mounted on the plates 33 is a first rod 37 which connects them to each other. A second rod 38, whose axis is parallel to that of the rod 37, is guided by its trunnions 39 in a slot 40 in the plate 33, said slot extending perpendicularly to the axis of the rod 38, and preferably in the direction of the vertical connecting line of the axes of the rods 37 and 38.

On the plates 33 there is further mounted a pivoted lever 42 which pivots on the pin 41 in a plane perpendicular to the axes of the rods 37 and 38. Fastened to one end 43 of the pivoted lever 42 is one end of an extension spring 44, whose other end is attached to the plate 33. The pivoted lever 42 further has a notch 45 in which one of the trunnions 39 of the displaceable rod 38 is lodged while the pivoted lever 42 moves from one of its extreme positions into the other. The two pivoted levers 42 may be linked by a connecting rod 46 to permit them to be actuated together.

As the pivoted lever 42 is moved from the extreme position shown in FIG. 4 into that shown in FIG. 3, which is done against the force of the extension spring 44, the rod 38 is raised by means of the trunnion 39 lodged in the notch 45, in other words, moved away from the rod 37, thus leaving a clearance between the rods 37 and 38. In the extreme position according to FIG. 3, the pivoted lever 42 is then able to latch, for which purpose an engageable and disengageable pin 47 may be provided. The end of the web 3 is then wrapped around the rod 38, passed between the rods 37 and 38, and brought down along the rod 37. The pin 47 is then depressed against the force of the spring 48 to release the end 49 of the pivoted lever 42, which then is pulled by the extension spring 44 back into the extreme position shown in FIG. 4. In the process, the displaceable rod 38 is entrained downwardly, in the direction of the rod 37, by the trunnion 39 lodged in the notch 45 of the pivoted lever 42 until it comes into contact with the rod 37. In this extreme position, the rod 38 is prevented by the pivoted lever 42 from being displaced, and by the extension spring 44 it is resiliently urged against the rod 37, thus clamping the head end of the web 3 introduced between the rods 37 and 38 for entrainment.

It will be appreciated that the instant specification and claims are set forth by way of illustration and not limitation, and that various changes and modifications may be made without departing from the spirit and scope of the present invention.

What is claimed is:

1. In an apparatus for the treatment of a web of material having rolls defining a conveying path for the web, the improvement comprising means for leading the head end of a web along the conveying path comprising means forming an endless loop on both sides of the conveying path, each having a run thereof extending along the conveying path and means connected across the two loops for securing the head end of a web during the leading thereof along the conveying path, wherein the means for securing comprises a crossbeam connecting the two loops, the crossbeam comprising two rods and means mounting the rods with parallel axes for movement relative to each other between a closed position wherein the head end of a web is clamped therebetween and an open position wherein a clearance is obtained through which the head end can be threaded.

2. The apparatus according to claim 1, wherein the means forming the endless loops comprises two endless chains.

3. The apparatus according to claim 1, wherein the mounting means mounts at least one of the rods for displacement perpendicular to its axis.

4. The apparatus according to claim 3, wherein the mounting means comprises spring means for biasing the rods into contact with each other.

5. The apparatus according to claim 4, wherein the crossbeam further comprises two pivoted levers for effecting movement of the rods between the open and closed positions and means for latching the levers to maintain the rods in the open position.

6. The apparatus according to claim 5, wherein the means mounting the rods comprises a plate mounted on each of the facing sides of the loops and rigidly interconnected by one of the rods, the plates having elongated slots perpendicular to the rod axes and in which the other rod having trunnions is guided between a first position corresponding to the open position and a second position corresponding to the closed position, wherein the pivoted levers are pivoted on the plates and have a notch therein coactive with the trunnions of the other rod and the spring means comprises an extension spring connecting each lever to its associated plate.

7. The apparatus according to claim 6, further comprising a rod connecting the two levers together to effect simultaneous operation thereof.

* * * * *